US009802298B2

(12) United States Patent
Hu

(10) Patent No.: US 9,802,298 B2
(45) **Date of Patent: *Oct. 31, 2017**

(54) ELECTRIC RATCHET WRENCH

(71) Applicant: Bobby Hu, Taichung (TW)

(72) Inventor: Bobby Hu, Taichung (TW)

( * ) Notice: Subject to any disclaimer, the term of this patent is extended or adjusted under 35 U.S.C. 154(b) by 2 days.

This patent is subject to a terminal disclaimer.

(21) Appl. No.: 15/009,877

(22) Filed: Jan. 29, 2016

(65) Prior Publication Data

US 2016/0339568 A1 Nov. 24, 2016

(30) Foreign Application Priority Data

May 22, 2015 (TW) ..... 104116572 A

(51) Int. Cl.

| | |
|---|---|
| ***B25B 21/00*** | (2006.01) |
| ***B25B 23/14*** | (2006.01) |
| ***B25B 13/46*** | (2006.01) |
| ***B25B 23/00*** | (2006.01) |

(52) U.S. Cl.

CPC ..... *B25B 21/004* (2013.01); *B25B 13/465* (2013.01); *B25B 23/0035* (2013.01); *B25B 23/141* (2013.01); *B25B 21/00* (2013.01)

(58) Field of Classification Search

CPC . B25B 21/004; B25B 13/465; B25B 23/0035; B25B 23/141; B25B 21/00; B25B 21/002; B25B 13/463

USPC ..... 81/57.13

See application file for complete search history.

(56) References Cited

U.S. PATENT DOCUMENTS

| | | | | |
|---|---|---|---|---|
| 2,179,724 | A * | 11/1939 | Kuehne | B25B 21/00 192/48.1 |
| 2,621,767 | A * | 12/1952 | McDevitt | B25B 23/00 192/56.61 |
| 3,707,893 | A | 1/1973 | Hofman | |
| 3,756,090 | A | 9/1973 | Mella et al. | |
| 4,023,744 | A | 5/1977 | Shutt | |
| 4,524,649 | A | 6/1985 | Diaz et al. | |
| 4,653,359 | A * | 3/1987 | Liao | B25B 23/147 173/93 |
| 5,305,670 | A | 4/1994 | Fossella et al. | |
| 5,709,136 | A | 1/1998 | Frenkel | |

(Continued)

FOREIGN PATENT DOCUMENTS

| | | |
|---|---|---|
| CN | 201020685 Y | 2/2008 |
| DE | 20309684 U1 | 9/2003 |

(Continued)

*Primary Examiner* — Larry E Waggle, Jr.
*Assistant Examiner* — Danny Hong
(74) *Attorney, Agent, or Firm* — Alan D. Kamrath; Kamrath IP Lawfirm, P.A.

(57) ABSTRACT

An electric ratchet wrench includes a driving member rotatably mounted in a body. A pawl device is pivotably mounted to the driving member. A ring gear is rotatably mounted around the driving member. A flexible transmission shaft includes a first end connected to a motor and a second end configured to switch between a meshing state meshed with the ring gear and a disengagement state disengaging from the ring gear. The motor drives the transmission shaft to rotate the driving member. The body can be manually driven to overcome a resistance which is larger than the torque outputted by the motor and which causes a tooth slippage phenomenon between the transmission shaft and the ring gear.

15 Claims, 9 Drawing Sheets

(56) References Cited

U.S. PATENT DOCUMENTS

| | | | | |
|---|---|---|---|---|
| 6,062,939 | A * | 5/2000 | Parker | A63H 33/3072 446/145 |
| 6,070,499 | A | 6/2000 | Wisbey | |
| 6,209,422 | B1 | 4/2001 | Kamiya et al. | |
| 6,216,562 | B1 | 4/2001 | Hsieh | |
| 6,457,386 | B1 * | 10/2002 | Chiang | B25B 13/465 81/57.29 |
| 6,568,298 | B1 | 5/2003 | Zinck | |
| 7,104,165 | B2 | 9/2006 | Chu | |
| 7,406,900 | B1 * | 8/2008 | Hsieh | B25B 23/1427 81/475 |
| 7,444,902 | B1 * | 11/2008 | Lin | B25B 13/465 81/57.29 |
| 7,571,668 | B1 | 8/2009 | Chang | |
| 8,800,410 | B1 | 8/2014 | Huang | |
| 2003/0144615 | A1 | 7/2003 | Lin | |
| 2006/0060032 | A1 | 3/2006 | Baker | |
| 2007/0084310 | A1 | 4/2007 | Kobayashi | |
| 2008/0271574 | A1 | 11/2008 | Lin et al. | |
| 2009/0114058 | A1 | 5/2009 | Malone | |
| 2009/0114068 | A1 | 5/2009 | Lawrence | |
| 2014/0157961 | A1 | 6/2014 | Chen | |
| 2016/0075002 | A1 | 3/2016 | Hu et al. | |
| 2016/0075003 | A1 | 3/2016 | Hu et al. | |
| 2016/0339567 | A1 | 11/2016 | Hu | |
| 2016/0339568 | A1 | 11/2016 | Hu | |

FOREIGN PATENT DOCUMENTS

| | | | |
|---|---|---|---|
| JP | S62136378 | A | 6/1987 |
| JP | H0531873 | U | 4/1993 |
| JP | H0624867 | U | 4/1994 |
| TW | M290086 | U | 5/2006 |
| TW | 200838649 | A | 10/2008 |
| TW | I318912 | B | 1/2010 |
| TW | I319733 | B | 1/2010 |
| TW | M377293 | U | 4/2010 |
| TW | M413569 | U | 10/2011 |
| TW | M449063 | U | 3/2013 |
| WO | WO2008018221 | A1 | 2/2008 |

* cited by examiner

ELECTRIC RATCHET WRENCH

BACKGROUND

The present invention relates to a ratchet wrench and, more particularly, to an electric ratchet wrench.

U.S. Pat. No. 8,800,410 discloses a ratchet wrench with a direction switching structure. The ratchet wrench includes a wrench body, a ratchet wheel, a ratcheting member, and a switching member. The ratchet wheel is rotatably mounted in the wrench body and can couple with a socket. The ratcheting member is mounted in the wrench body and is selectively engaged with the ratchet wheel by using a left half portion or a right half portion of ratchet teeth of the ratcheting member to switch the rotating direction of the ratchet wheel. The switching member is pivotably mounted in the body and abuts the ratcheting member.

A user has to grip the wrench body and rotate the wrench body in opposite directions to drive the socket in a single direction. Long bolts are commonly used in a building construction site. Considerable time is required for repeated operations of the long bolts in opposite directions. Furthermore, the long bolts are apt to rust in outdoor building construction sites, and the user has to spend time and effort to tighten or loosen the rusted long bolts with conventional ratchet wrenches.

Thus, a need exists for a novel electric ratchet wrench to mitigate and/or obviate the above disadvantages.

BRIEF SUMMARY

This need and other problems in the field of easy driving of ratchet wrenches are solved by an electric ratchet wrench including a body having a first end and a second end spaced from the first end along a first axis. The first end of the body includes an inner periphery having a toothed portion. A driving device is mounted to the first end of the body. The driving device includes a driving member, a pawl device pivotably mounted to the driving member, and a ring gear rotatably mounted around the driving member. The driving member includes an end adapted for directly or indirectly driving a fastener. The pawl device is configured to selectively mesh with the toothed portion of the body. The ring gear is rotatable relative to the driving member in a clockwise direction or a counterclockwise direction. The ring gear includes an inner toothed portion on an inner periphery thereof and an end toothed portion on an end face thereof. The inner toothed portion of the ring gear is configured to selectively mesh with the pawl device. A power device is received in the second end of the body. The power device includes a motor. A transmission device includes a transmission shaft rotatably mounted to the body. The transmission shaft includes a first end connected to the motor. The transmission shaft further includes a second end configured to switch between a meshing state meshed with the end toothed portion of the ring gear and a disengagement state disengaging from the end toothed portion of the ring gear.

When a resistance smaller than a torque outputted by the motor is encountered while the driving member is driving a fastener, the transmission shaft is in the meshing state and drives the ring gear to rotate, and the driving member is rotated to continuously drive the fastener.

When a large resistance larger than the torque outputted by the motor is encountered at a position while the driving member is driving the fastener, the transmission shaft is in the disengagement state and causes a tooth slippage phenomenon in which the transmission shaft repeatedly engages with and disengages from the end toothed portion of the ring gear, such that the ring gear cannot be rotated, the body is permitted to be manually rotated to overcome the large resistance and to forcibly drive the fastener through the position via the driving member, and the transmission shaft reengages with the ring gear after the fastener passes through the position.

The body can include a connection hole. The transmission shaft is received in the connection hole and is rotatable about the first axis. The second end of the transmission shaft includes a gear normally meshed with the end toothed portion of the ring gear. The gear of the transmission shaft is switchable between the meshing state and the disengagement state. The transmission shaft deviates from the first axis when the gear of the transmission shaft is in the disengagement state, such that the tooth slippage phenomenon occurs between the gear of the transmission shaft and the end toothed portion of the ring gear.

In an example, the transmission shaft is flexible and includes a first section and a second section arranged along the first axis. The gear is located on an end of the first section. The other end of the first section is connected to an end of the second section. The other end of the second section is connected to the motor. The transmission device further includes first and second bearings. The first bearing is mounted between the first and second sections. The second bearing is mounted around the other end of the second section. When the gear is in the disengagement state, the first section flexibly deforms relative to the second section of the transmission shaft to deviate away from the first axis.

The transmission device can further include a restraining member mounted in the first end of the body and receiving the first section of the transmission shaft. The restraining member includes a restraining groove extending in a radial direction perpendicular to the first axis. The transmission shaft extends through and is restrained by the restraining groove. The first section of the transmission shaft is restricted to deviate away from the first axis along a second axis perpendicular to the first axis.

The body can include a handle adapted to be held by a user. The handle is located adjacent to the second end of the body and includes a through-hole extending in a radial direction perpendicular to the first axis. The through-hole extends in an outer periphery of the handle in a circumferential direction about the first axis. The power device further includes a power source and a control button. The motor is a bidirectional motor and includes a motor shaft. The power source is electrically connected to the motor for driving the motor shaft to rotate in the clockwise direction or the counterclockwise direction to thereby rotate the transmission shaft. The control button is received in the through-hole of the body and is electrically connected to the motor. The control button can be operated to control rotation of the motor shaft of the motor in the clockwise direction or the counterclockwise direction.

The electric ratchet wrench can further include a direction switching device having a direction switching rod extending through the driving member along the second axis perpendicular to the first axis. The direction switching rod is pivotable relative to the driving member between two positions respectively corresponding to a driving direction and a non-driving direction. The pawl device includes two primary pawls and a secondary pawl. The two primary pawls are configured to selectively mesh with the toothed portion of the body. The inner toothed portion of the ring gear is configured to selectively mesh with the secondary pawl.

When the direction switching rod pivots between the two positions, an engagement status between each of the two primary pawls and the toothed portion of the body and an engagement status between the secondary pawl and the ring gear are changed to provide a direction switching function.

Each of the two primary pawls can include first and second primary toothed sections respectively located on opposite ends of a side of the primary pawl facing away from the driving member. The first and second primary toothed sections are configured to selectively mesh with the toothed portion of the body. The secondary pawl can include first and second secondary toothed sections respectively located on opposite ends of a side of the secondary pawl facing away from the driving member. The first and second secondary toothed sections are configured to selectively engage with the inner toothed portion of the ring gear for joint rotation.

The driving device can further include first and second pins. The driving member is rotatably mounted in the body and rotatable about the second axis. The first pin extends through the driving member, one of the two primary pawls, and the secondary pawl, permitting the one of the two primary pawls and the secondary pawl to jointly pivot relative to driving member about a third axis parallel to the second axis and defined by the first pin. The second pin extends through the driving member and the other of the two primary pawls, permitting the other of the two primary pawls to pivot relative to driving member about a fourth axis parallel to the second axis and defined by the second pin. The second axis is located between the third and fourth axes. The two primary pawls are located on the same level along the second axis. The secondary pawl is located at a level different from the two primary pawls along the second axis and is spaced from the second axis in a radial direction perpendicular to the second axis.

The direction switching rod can include a through-hole extending in a diametric direction perpendicular to the second axis. The direction switching rod can further include a receptacle spaced from the through-hole of the direction switching rod along the second axis. The receptacle has an opening. The direction switching device further includes a primary pressing unit and a secondary pressing unit. The primary pressing unit is mounted in the through-hole of the direction switching rod and includes two first pressing members and a first biasing element mounted between the two first pressing members and biasing the two first pressing members to respectively press against the two primary pawls. The secondary pressing unit is mounted in the receptacle of the direction switching rod and includes a second pressing member and a second biasing element biasing the second pressing member to press against the secondary pawl.

The body can include a head and an extension between the head and the handle. The head is located on the first end of the body. The handle is located between the extension and the second end of the body along the first axis. The head includes a driving hole and a transmission groove intercommunicated with the driving hole. The driving hole includes the inner periphery having the toothed portion. The handle includes a compartment receiving the power device. The connection hole is defined in the extension. The handle of the body includes the through-hole, and the through-hole intercommunicates with the compartment.

Illustrative embodiments will become clearer in light of the following detailed description described in connection with the drawings.

DESCRIPTION OF THE DRAWINGS

The illustrative embodiments may best be described by reference to the accompanying drawings where.

Figure 1:
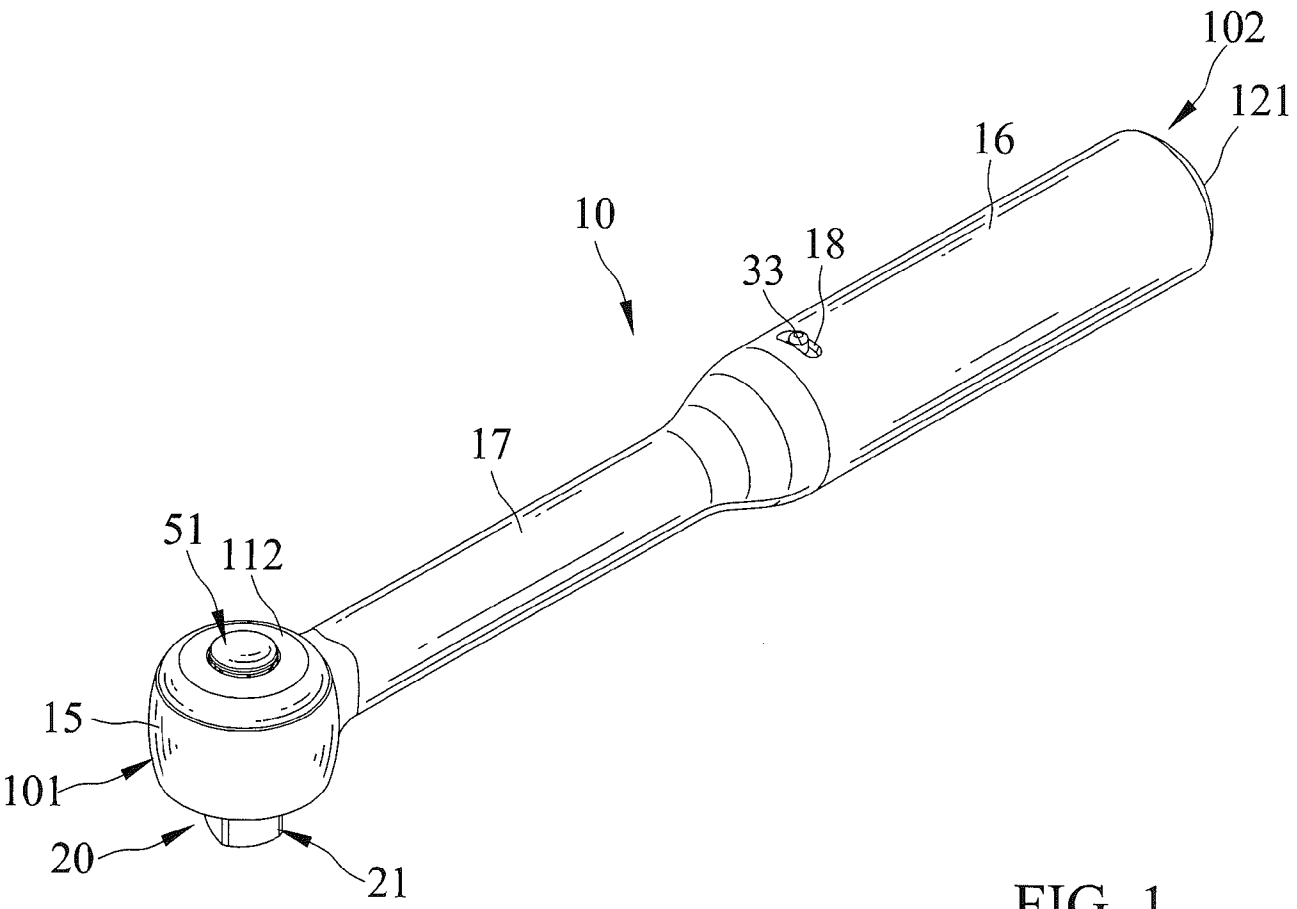
FIG. 1 is a perspective view of an electric ratchet wrench according to the present invention.
Figure 2:
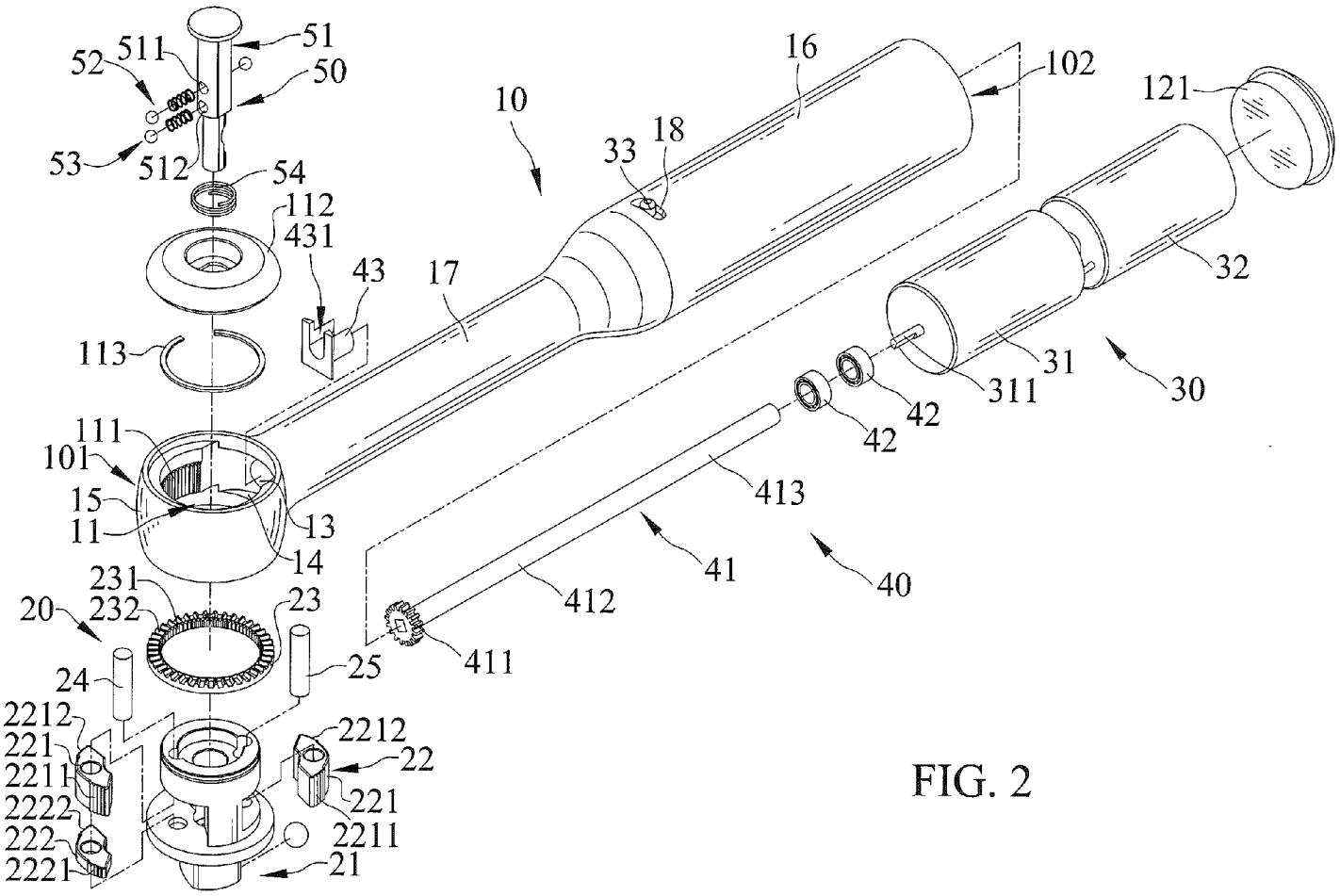
FIG. 2 is an exploded, perspective view of the electric ratchet wrench of FIG. 1.
Figure 3:
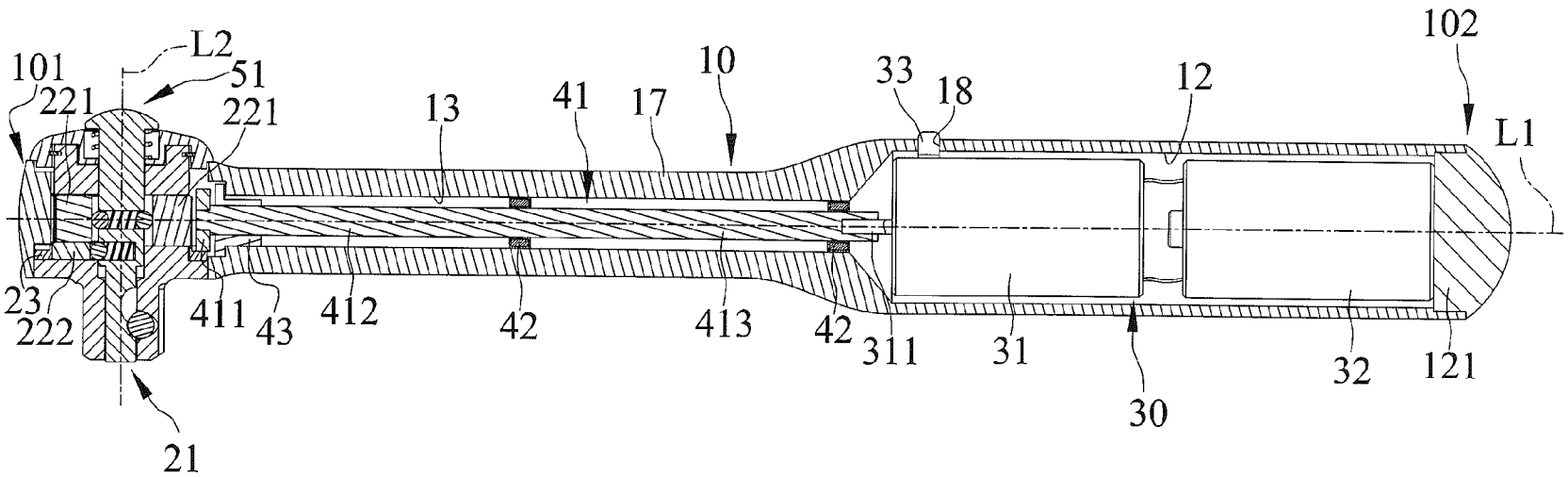
FIG. 3 is a cross sectional view of the electric ratchet wrench of FIG. 1 with a gear of a transmission shaft meshed with a ring gear.
Figure 4:
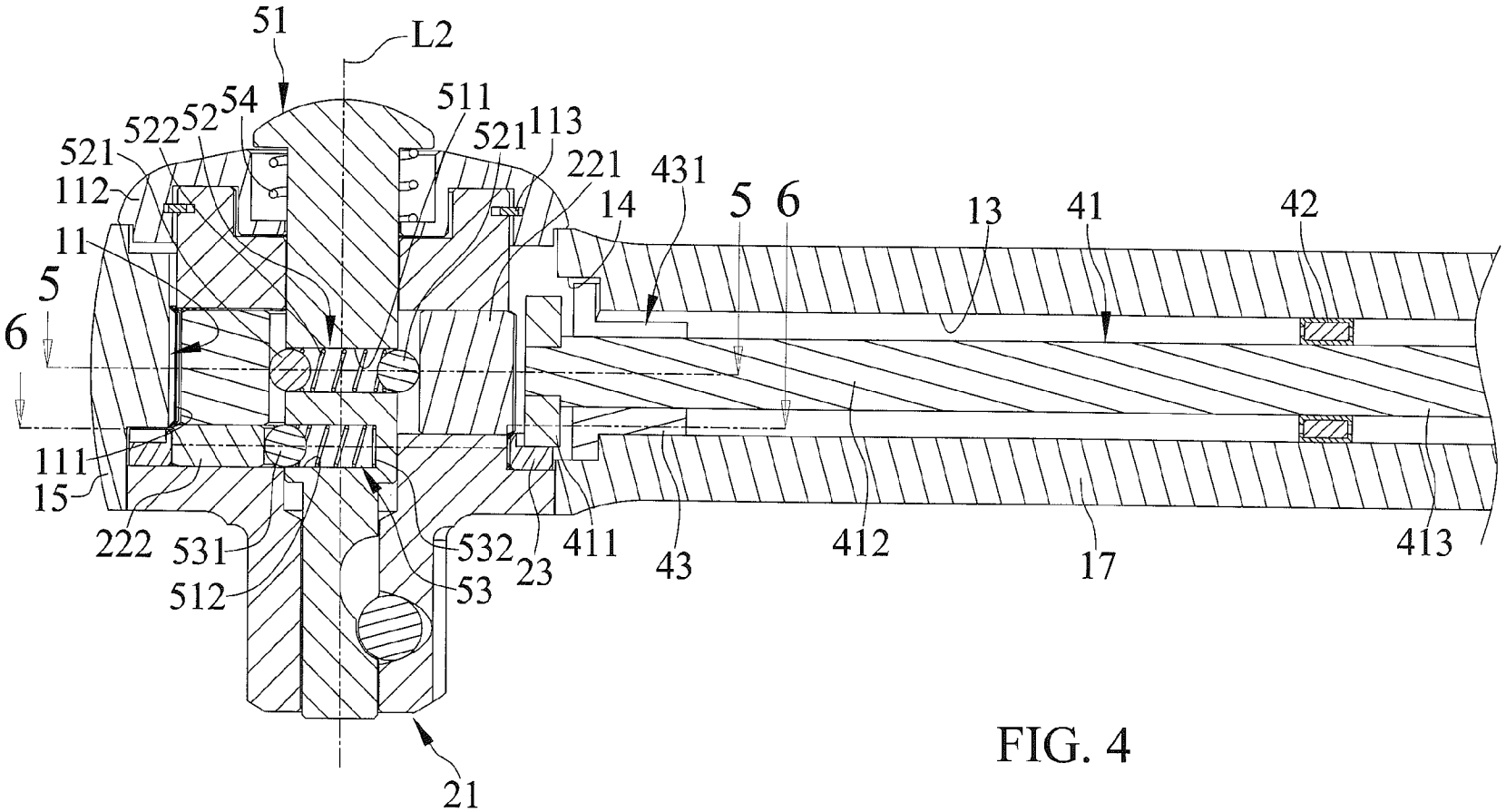
FIG. 4 is an enlarged view of a portion of FIG. 3.
Figure 5:
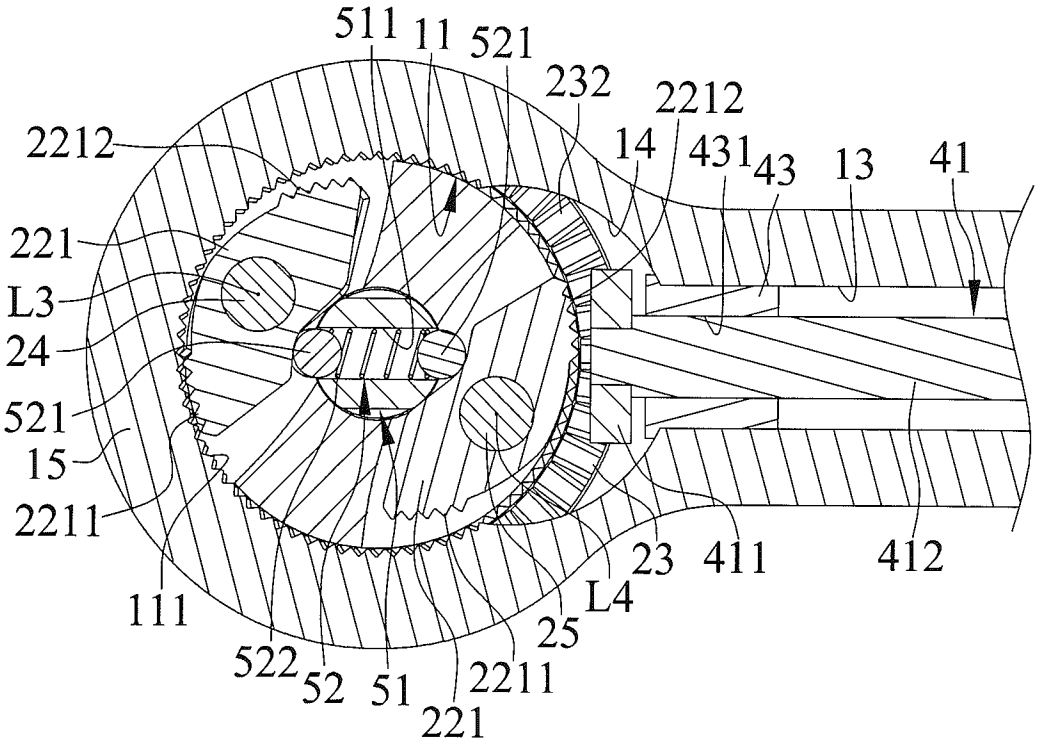
FIG. 5 is a cross sectional view taken along section line 5-5 of FIG. 4, illustrating engagement between one of two toothed sections of each of two primary pawls and a toothed portion of a body.
Figure 6:
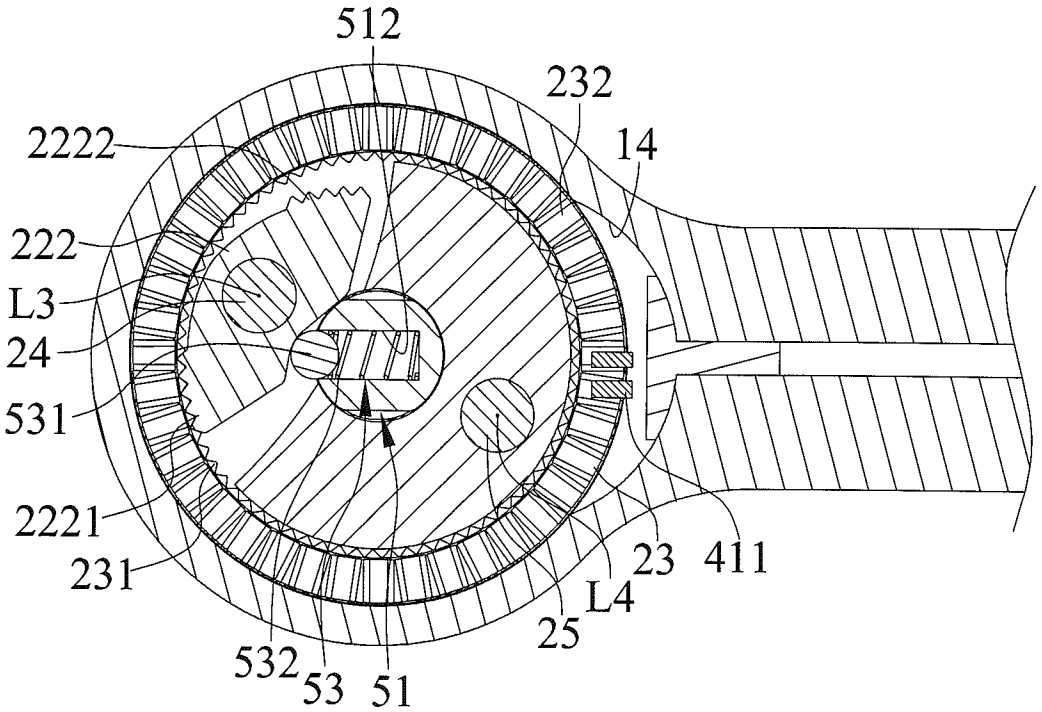
FIG. 6 is a cross sectional view taken along section line 6-6 of FIG. 4, illustrating engagement between one of the toothed sections of a secondary pawl and the ring gear.

All figures are drawn for ease of explanation of the basic teachings only; the extensions of the figures with respect to number, position, relationship, and dimensions of the parts to form the illustrative embodiments will be explained or will be within the skill of the art after the following teachings have been read and understood. Further, the exact dimensions and dimensional proportions to conform to specific force, weight, strength, and similar requirements will likewise be within the skill of the art after the following teachings have been read and understood.

Where used in the various figures of the drawings, the same numerals designate the same or similar parts. Furthermore, when the terms "first", "second", "third", "fourth", "bottom", "side", "end", "portion", "section", "radial", "transverse", "circumferential", and similar terms are used herein, it should be understood that these terms have reference only to the structure shown in the drawings as it would appear to a person viewing the drawings and are utilized only to facilitate describing the illustrative embodiments.

DETAILED DESCRIPTION

FIGS. 1-9 show an electric ratchet wrench of an embodiment according to the present invention. The electric ratchet wrench includes a body 10, a driving device 20, a power device 30, and a transmission device 40.

Body 10 includes a first end 101 and a second end 102 spaced from first end 101 along a first axis L1. Body 10 further includes a driving hole 11, a compartment 12, a connection hole 13, and a transmission groove 14. Driving hole 11 is defined in first end 101 of body 10 and includes an inner periphery having a toothed portion 111 distant to compartment 12. Compartment 12 is adjacent to second end 102 of body 10 and intercommunicates with an end of connection hole 13. A cap 121 is mounted to an outer end of compartment 12 opposite to connection hole 13. The other end of connection hole 13 intercommunicates with an end of transmission groove 14. The other end of transmission groove 14 intercommunicates with driving hole 11. A cover 112 is mounted to first end 101 of body 10 to seal a side of driving hole 11. A retainer 113 is mounted in driving hole 11 and engages with cover 112.

In this embodiment, body 10 includes a head 15, a handle 16 adapted to be held by a user, and an extension 17 between head 15 and handle 16. Head 15 is located on first end 101 of body 10. Handle 16 is located between extension 17 and second end 102 of body 10 along first axis L1. Head 15 includes driving hole 11 and transmission groove 14. Transmission groove 14 is crescent in cross section and includes two closed ends spaced from each other in a transverse direction perpendicular to first axis L1. Handle 16 includes compartment 12. Handle 16 further includes a through-hole 18 extending in a radial direction perpendicular to first axis L1 and intercommunicating with compartment 12. Furthermore, through-hole 18 extends in the outer periphery of handle 16 in a circumferential direction about first axis L1. Connection hole 13 is defined in extension 17.

Driving device 20 is mounted to first end 101 of body 10. Driving device 20 includes a driving member 21, a pawl device 22, and a ring gear 23 rotatably mounted around driving member 21. Driving member 21 is rotatably mounted in body 10 and is rotatable about a second axis L2 perpendicular to first axis L1. An end of driving member 21 adjacent to ring gear 23 is adapted for directly or indirectly driving a fastener. Retainer 113 is mounted between an outer periphery of driving member 21 and cover 112 to avoid disengagement of driving member 21 from driving hole 11. In the form shown, the end of driving member 21 can couple with a socket or an extension rod for driving a faster, such as a bolt, a nut, etc.

Ring gear 23 is rotatable relative to driving member 21 in a clockwise direction or a counterclockwise direction. Ring gear 23 includes an inner toothed portion 231 on an inner periphery thereof and an end toothed portion 232 on an end face thereof.

Pawl device 22 includes two primary pawls 221 and a secondary pawl 222. Each primary pawl 221 is pivotably mounted to driving member 21 and is configured to selectively mesh with toothed portion 111 of body 10.

Each of the two primary pawls 221 includes first and second primary toothed sections 2211 and 2212 respectively located on opposite ends of a side of primary pawl 221 facing away from driving member 21. First and second primary toothed sections 2211 and 2212 are configured to selectively mesh with toothed portion 111. Secondary pawl 222 includes first and second secondary toothed sections 2221 and 2222 respectively located on opposite ends of a side of secondary pawl 222 facing away from driving member 21. First and second secondary toothed sections 2221 and 2222 are configured to selectively engage with end toothed portion 232 of ring gear 23 for joint rotation.

One of the two primary pawls 221 and secondary pawl 222 are jointly pivotable relative to driving member 21 about a third axis L3 parallel to the second axis L2. In this embodiment, third axis L3 is defined by a first pin 24 extending through driving member 21, the one of the two primary pawls 221, and secondary pawl 222. The other primary pawl 221 is pivotable relative to driving member 21 about a fourth axis L4 parallel to the second axis L2. In this embodiment, fourth axis L4 is defined by a second pin 25 extending through driving member 21 and the other primary pawl 221. Second axis L2 is located between third and fourth axes L3 and L4. Primary pawls 221 are located on the same level along second axis L2. Secondary pawl 222 is located on a level different from primary pawls 221 along second axis L2 and is spaced from second axis L2 in a radial direction perpendicular to second axis L2.

Power device 30 is received in compartment 12 of body 10 and includes a motor 31, a power source 32, and a control button 33. Cap 121 is detachably mounted to the outer end of compartment 12 to avoid power device 30 from falling out of compartment 12 while permitting replacement of power source 32 after detaching cap 121. In this embodiment, motor 31 is a bidirectional motor and includes a motor shaft 311. Power source 32 is electrically connected to motor 31 for driving motor shaft 311 to rotate about first axis L1 in the clockwise direction or the counterclockwise direction. Control button 33 is received in through-hole 18 of body 10 and is electrically connected to motor 31. Control button 33 can be operated to control rotation of motor shaft 311 of motor 31 in the clockwise direction or the counterclockwise direction.

Transmission device 40 includes a transmission shaft 41 mounted in connection hole 13 of body 10 and is rotatable about first axis L1. Transmission shaft 41 includes a first end connected to motor shaft 311 and a second end having a gear 411. Gear 411 normally meshes with end toothed portion 232 of ring gear 23. Gear 411 is switchable between a meshing state meshed with end toothed portion 232 of ring gear 23 and a disengagement state disengaged from end toothed portion 232 of ring gear 23.

In this embodiment, transmission shaft 41 is flexible and includes first and second sections 412 and 413 arranged along first axis L1. Gear 411 is located on an end of first section 412. The other end of first section 412 is connected to an end of second section 413. The other end of second section 413 is connected to motor shaft 311. Transmission device 40 further includes first and second bearings 42. First bearing 42 is mounted between first and second sections 412 and 413. Second bearing 42 is mounted around the other end of second section 413. When gear 411 is in the disengagement state, first section 412 flexibly deforms relative to second section 413 of transmission shaft 41 to deviate away from first axis L1.

Transmission device 40 further includes a restraining member 43 mounted in first end 101 of body 10 in a location between connection hole 13 and transmission groove 14. Restraining member 43 receives first section 412 of transmission shaft 41 and includes a restraining groove 431 extending in a radial direction perpendicular to first axis L1. Thus, transmission shaft 41 extends through and is restrained by restraining groove 431, such that when transmission shaft 41 is in the disengaged state and deviates away from first axis L1, the second end of transmission shaft 41 with gear 411 deviates along an axis parallel to second axis L2 to avoid transmission shaft 41 from vibrating in connection hole 13.

The electric ratchet wrench further includes a direction switching device 50 having a direction switching rod 51 pivotably extending through cover 112 and driving member 21. Direction switching rod 51 is pivotable about second axis L2 relative to driving member 21 between two positions respectively corresponding to a driving direction and a non-driving direction. When direction switching rod 51 pivots between the two positions, an engagement status between each primary pawl 221 and toothed portion 111 of body 10 and an engagement status between secondary pawl 222 and ring gear 23 are changed to provide a direction switching function, which can be appreciated by one having ordinary skill in the art. Thus, the user can pivot direction switching rod 51 about second axis L2 to change the pressing direction of the two first pressing members 521 against the two primary pawls 221 and the pressing direction of second pressing member 531 of secondary pressing unit 53 against secondary pawl 222.

When direction switching rod 51 is in one of the two positions (FIGS. 5 and 6), first primary toothed section 2211 of one of the two primary pawls 221 and second primary toothed section 2212 of the other primary pawl 221 mesh with toothed portion 111. First secondary toothed section 2221 of secondary pawl 222 meshes with end toothed portion 232 of ring gear 23. On the other hand, when direction switching rod 51 is in the other position (FIGS. 8 and 9), second primary toothed section 2212 of the one of the two primary pawls 221 and first primary toothed section 2211 of the other primary pawl 221 mesh with toothed portion 111. Second secondary toothed section 2222 of secondary pawl 222 meshes with end toothed portion 232 of ring gear 23.

In this embodiment, direction switching rod 51 includes a through-hole 511 extending in a diametric direction perpendicular to second axis L2. Direction switching rod 51 further includes a receptacle 512 spaced from through-hole 511 of direction switching rod 51 along second axis L2 and having an opening.

Direction switching device 50 further includes a primary pressing unit 52 and a secondary pressing unit 53. Primary pressing unit 52 is mounted in through-hole 511 of direction switching rod 51 and includes two first pressing members 521 and a first biasing element 522 mounted between the two first pressing members 521 and biasing the two first pressing members 521 to respectively press against the two primary pawls 221. Secondary pressing unit 53 includes a second pressing member 531 and a second biasing element 532 biasing second pressing member 531 to press against secondary pawl 222.

Direction switching device 50 further includes a return spring 54 in the form of a coil spring mounted around direction switching rod 51. Return spring 54 is mounted between a head of direction switching rod 51 and cover 112. Direction switching rod 51 can move relative to driving member 21 along second axis L2 between an initial position and a disengagement position. Driving member 21 can couple with a socket when direction switching rod 51 is in the initial position, and the socket cannot be disengaged from driving member 21. On the other hand, when direction switching rod 51 is moved to the disengagement position, the socket can be disengaged from driving member 21, and return spring 54 is compressed. Return spring 54 provides a returning force for returning direction switching rod 51 from the disengagement position to the initial position. Thus, direction switching rod 51 is normally in the initial position.

Gear 411 of transmission shaft 41 normally meshes with end toothed portion 232 of ring gear 23. When motor shaft 311 of motor 31 drives transmission shaft 41 to rotate about first axis L1, ring gear 23 is driven to rotate in the clockwise direction or the counterclockwise direction relative to driving member 21. Primary pawls 221 and secondary pawl 222 actuate driving member 21 to rotate to thereby directly or indirectly rotate a fastener. Thus, the electric ratchet wrench can drive driving member 21 to rotate about second axis L2 by rotating motor shaft 311 of motor 31 about first axis L1 without moving handle 16.

If a resistance smaller than a torque outputted by motor 31 is encountered while driving member 21 is driving a fastener, gear 411 of transmission shaft 41 is in the meshing state meshing with end toothed portion 232 and, thus, drives ring gear 23 to rotate, and driving member 21 is rotated to continuously drive the fastener, providing a force saving effect.

Figure 7:
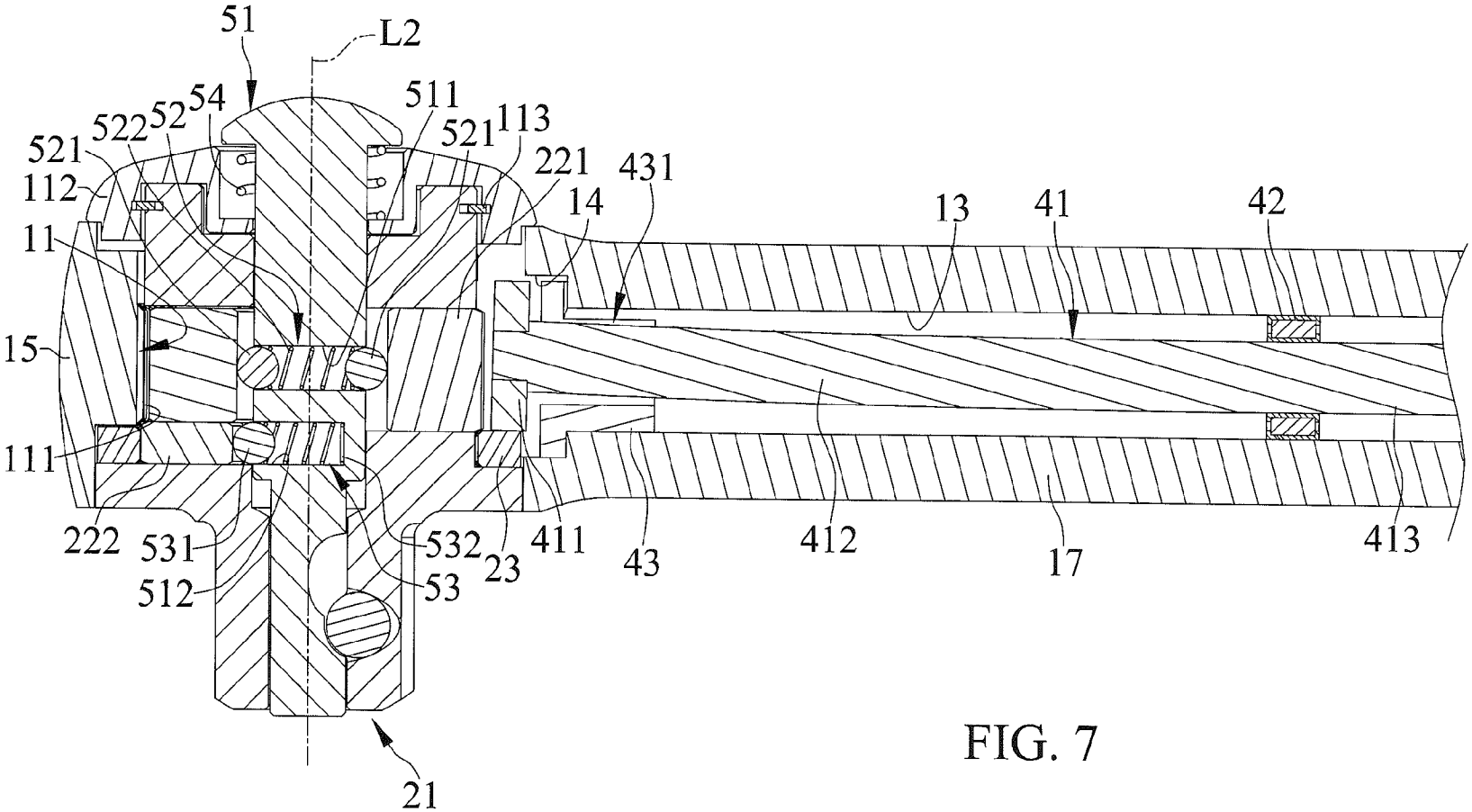
FIG. 7 is a view similar to FIG. 4 with the gear of the transmission shaft disengaged from the ring gear.
Figure 8:
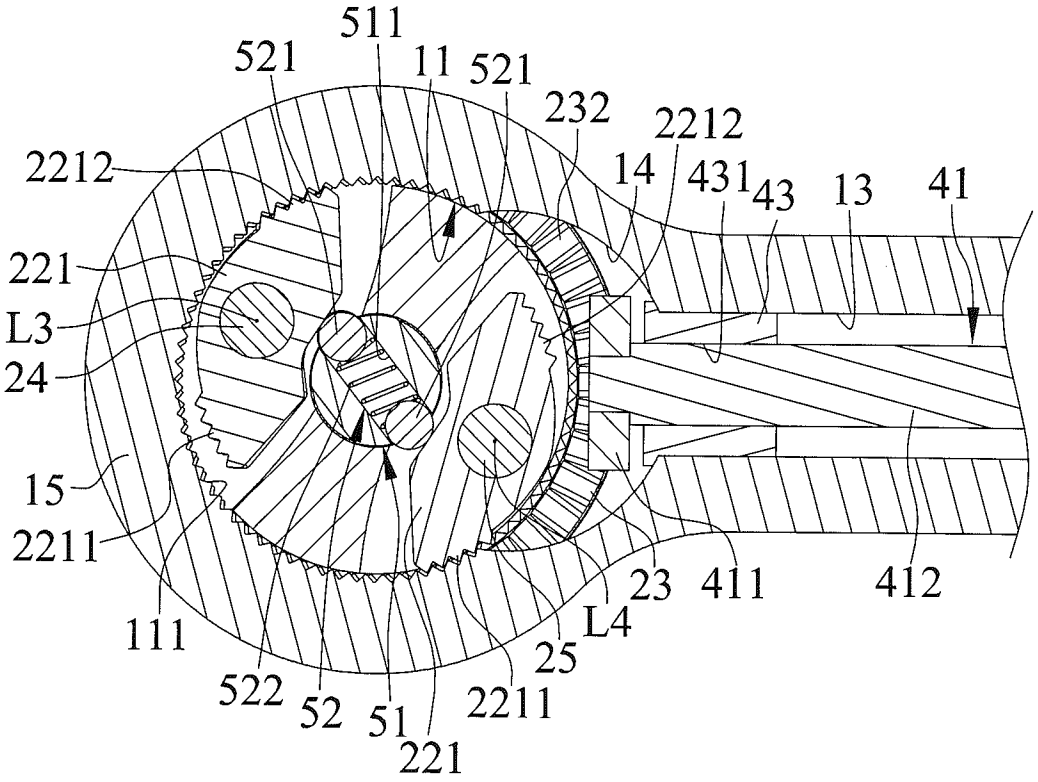
FIG. 8 is a view similar to FIG. 5 with the other toothed section of each primary pawl meshed with the toothed portion of the body.
Figure 9:
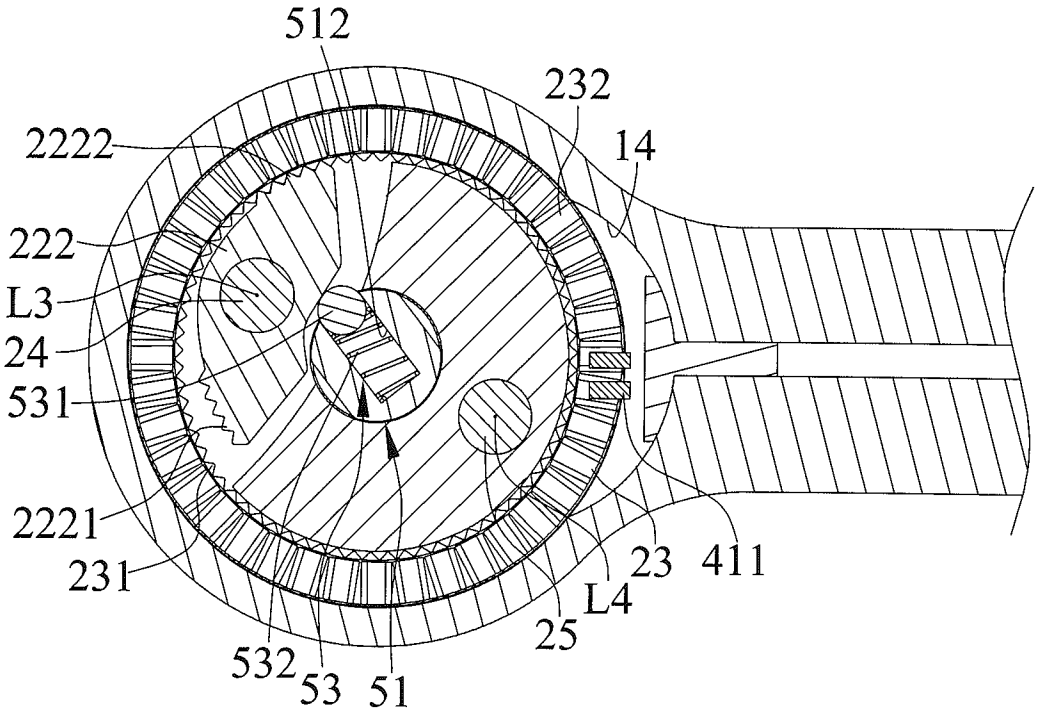
FIG. 9 is a view similar to FIG. 6 with the other toothed section of the secondary pawl meshed with the ring gear.

With reference to FIG. 7, on the other hand, if a large resistance larger than the torque outputted by motor 31 is encountered at a position while driving member 21 is driving the fastener (such as a rusted long bolt on a construction site), the torque outputted by motor shaft 311 is insufficient to drive transmission shaft 41 to rotate driving member 21. Namely, driving member 21 cannot drive the fastener. Gear 411 of transmission shaft 41 is in the disengaged state, and first section 412 of transmission shaft 41 flexibly deforms relative to first section 412 and deviates from first axis L1. Thus, a tooth slippage phenomenon occurs between gear 411 of transmission shaft 41 and end toothed portion 232 of ring gear 23. Namely, gear 411 of transmission shaft 41 repeatedly engages with and disengages from end toothed portion 232 of ring gear 23, such that ring gear 23 cannot be rotated by gear 411. The user can hear clicks resulting from the tooth slippage phenomenon and, thus, be aware of failure of engagement between gear 411 and end toothed portion 232 of ring gear 23. In this case, the user can manually rotate handle 16, using toothed portion 111 of body 10 to mesh with one of primary pawls 221. Thus, driving member 21 is driven by body 10 to drive the fastener. After the fastener passes through the large-resistance position, gear 411 of transmission shaft 41 reengages with end toothed portion 232 of ring gear 23 under the elastic returning force of flexible first section 412 of transmission shaft 41. Thus, driving member 21 can be driven by motor 31 again to rotate about second axis L2 to thereby drive the fastener to rotate. Thus, the problems of conventional non-manually-driven ratchet wrenches resulting from excessive large resistances are overcome.

Thus since the illustrative embodiments disclosed herein may be embodied in other specific forms without departing from the spirit or general characteristics thereof, some of which forms have been indicated, the embodiments described herein are to be considered in all respects illustrative and not restrictive. The scope is to be indicated by the appended claims, rather than by the foregoing description, and all changes which come within the meaning and range of equivalency of the claims are intended to be embraced therein.

The invention claimed is:

1. An electric ratchet wrench comprising:

a body having a first end and a second end spaced from the first end along a first axis, with the first end of the body including an inner periphery having a toothed portion, with the body including a connection hole;

a driving device mounted to the first end of the body, with the driving device including a driving member, a pawl device pivotably mounted to the driving member, and a ring gear rotatable mounted around the driving member, with the driving member including an end adapted for directly or indirectly driving a fastener, with the pawl device configured to selectively mesh with the toothed portion of the body, with the ring gear rotatable relative to the driving member in a clockwise direction or a counterclockwise direction, with the ring gear including an inner toothed portion on an inner periphery thereof and an end toothed portion on an end face thereof, and with the inner toothed portion of the ring gear configured to selectively mesh with the pawl device;

a power device received in the second end of the body, with the power device including a motor; and a transmission device including a transmission shaft received rotatably in the connection hole of the body and moveable to be aligned with the first axis and to be deviated away from the first axis, with the transmission shaft including a first end connected to the motor, with the transmission shaft further including a second end including a gear normally meshed with the end toothed portion of the ring gear, with the gear of the transmission shaft switchable between a meshing state meshed with the end toothed portion of the ring gear with the transmission shaft aligned with and rotatable about the first axis and a disengagement state disengaging from the end toothed portion of the ring gear with the transmission shaft deviated away from the first axis;

wherein when a resistance smaller than a torque outputted by the motor is encountered while the driving member is driving a fastener, the gear of the transmission shaft is in the meshing state and drives the ring gear to rotate, and the driving member is rotated to continuously drive the fastener, and wherein when a large resistance larger than the torque outputted by the motor is encountered at a position while the driving member is driving the fastener, the transmission shaft deviates from the first axis, wherein the gear of the transmission shaft is in the disengagement state and causes a tooth slippage phenomenon in which the gear of the transmission shaft repeatedly engages with and disengages from the end toothed portion of the ring gear, such that the ring gear cannot be rotated, the body is permitted to be manually rotated to overcome the large resistance and to forcibly drive the fastener through the position via the driving member, and the gear of the transmission shaft reengages with the end toothed portion of the ring gear after the fastener passes through the position.

2. The electric ratchet wrench as claimed in claim 1, with the transmission shaft being flexible and including a first section and a second section arranged along the first axis, with the gear located on an end of the first section, with another end of the first section connected to an end of the second section, with another end of the second section connected to the motor, with the transmission device further including first and second bearings, with the first bearing mounted between the first and second sections, and with the second bearing mounted around the other end of the second section, wherein when the gear is in the disengagement state, the first section flexibly deforms relative to the second section of the transmission shaft to deviate away from the first axis.

3. The electric ratchet wrench as claimed in claim 2, with the transmission device further including a restraining member mounted in the first end of the body and receiving the first section of the transmission shaft, with the restraining member including a restraining groove extending in a radial direction perpendicular to the first axis, and with the transmission shaft extending through and restrained by the restraining groove, wherein the first section of the transmission shaft is restricted to deviate away from the first axis along a second axis perpendicular to the first axis.

4. The electric ratchet wrench as claimed in claim 1, with the body including a handle adapted to be held by a user, with the handle located adjacent to the second end of the body and including a through-hole extending in a radial direction perpendicular to the first axis, with the through-hole extending in an outer periphery of the handle in a circumferential direction about the first axis, with the power device further including a power source and a control button, with the motor being a bidirectional motor and including a motor shaft, with the power source electrically connected to the motor for driving the motor shaft to rotate in the clockwise direction or the counterclockwise direction to thereby rotate the transmission shaft, with the control button received in the through-hole of the body and electrically connected to the motor, and with the control button operable to control rotation of the motor shaft of the motor in the clockwise direction or the counterclockwise direction.

5. The electric ratchet wrench as claimed in claim 4, further comprising a direction switching device including a direction switching rod extending through the driving member along a second axis perpendicular to the first axis, with the direction switching rod pivotable relative to the driving member between two positions respectively corresponding to a driving direction and a non-driving direction, with the pawl device including two primary pawls and a secondary pawl, with the two primary pawls configured to selectively mesh with the toothed portion of the body, and with the inner toothed portion of the ring gear configured to selectively mesh with the secondary pawl, wherein when the direction switching rod pivots between the two positions, an engagement status between each of the two primary pawls and the toothed portion of the body and an engagement status between the secondary pawl and the ring gear are changed to provide a direction switching function.

6. The electric ratchet wrench as claimed in claim 5, with each of the two primary pawls including first and second primary toothed sections respectively located on opposite ends of a side of the primary pawl facing away from the driving member, with the first and second primary toothed sections configured to selectively mesh with the toothed portion of the body, with the secondary pawl including first and second secondary toothed sections respectively located on opposite ends of a side of the secondary pawl facing away from the driving member, and with the first and second secondary toothed sections configured to selectively engage with the inner toothed portion of the ring gear for joint rotation.

7. The electric ratchet wrench as claimed in claim 5, with the driving device further including first and second pins, with the driving member rotatably mounted in the body and rotatable about the second axis, with the first pin extending through the driving member, one of the two primary pawls, and the secondary pawl, permitting the one of the two primary pawls and the secondary pawl to jointly pivot relative to the driving member about a third axis parallel to the second axis and defined by the first pin, with the second pin extending through the driving member and another of the two primary pawls, permitting the other of the two primary pawls to pivot relative to the driving member about a fourth axis parallel to the second axis and defined by the second pin, with the second axis located between the third and fourth axes, with the two primary pawls located on a same level along the second axis, and with the secondary pawl located at a level different from the two primary pawls along the second axis and spaced from the second axis in a radial direction perpendicular to the second axis.

8. The electric ratchet wrench as claimed in claim 5, with the direction switching rod including a through-hole extending in a diametric direction perpendicular to the second axis, with the direction switching rod further including a receptacle spaced from the through-hole of the direction switching rod along the second axis, with the receptacle having an opening, with the direction switching device further including a primary pressing unit and a secondary pressing unit, with the primary pressing unit mounted in the through-hole of the direction switching rod and including two first pressing members and a first biasing element mounted between the two first pressing members and biasing the two first pressing members to respectively press against the two primary pawls, and with the secondary pressing unit mounted in the receptacle of the direction switching rod and including a second pressing member and a second biasing element biasing the second pressing member to press against the secondary pawl.

9. The electric ratchet wrench as claimed in claim 4, with the body including a head and an extension between the head and the handle, with the head located on the first end of the body, with the handle located between the extension and the second end of the body along the first axis, with the head including a driving hole and a transmission groove intercommunicated with the driving hole, with the driving hole including the inner periphery having the toothed portion, with the handle including a compartment receiving the power device, with the connection hole defined in the extension, with the handle of the body including the through-hole, and with the through-hole intercommunicated with the compartment.

10. An electric ratchet wrench comprising:

a body having a first end and a second end spaced from the first end along a first axis, with the first end of the body including an inner periphery having a toothed portion, with the body including a handle adapted to be held by a user, with the handle located adjacent to the second end of the body and including a through-hole extending in a radial direction perpendicular to the first axis, with the through-hole extending in an outer periphery of the handle in a circumferential direction about the first axis; a driving device mounted to the first end of the body, with the driving device including a driving member, a pawl device pivotably mounted to the driving member, and a ring gear rotatably mounted around the driving member, with the driving member including an end adapted for directly or indirectly driving a fastener, with the pawl device configured to selectively mesh with the toothed portion of the body, with the ring gear rotatable relative to the driving member in a clockwise direction or a counterclockwise direction, with the ring gear including an inner toothed portion on an inner periphery thereof and an end toothed portion on an end face thereof, and with the inner toothed portion of the ring gear configured to selectively mesh with the pawl device; a transmission device including a transmission shaft rotatably mounted to the body; and a power device received in the second end of the body, with the power device including a motor, a power source and a control button, with the motor being a bidirectional motor and including a motor shaft, with the power source electrically connected to the motor for driving the motor shaft to rotate in the clockwise direction or the counterclockwise direction to thereby rotate the transmission shaft, with the control button received in the through-hole of the body and electrically connected to the motor, and with the control button operable to control rotation of the motor shaft of the motor in the clockwise direction or the counterclockwise direction, with the transmission shaft including a first end connected to the motor, with the transmission shaft further including a second end configured to switch between a meshing state meshed with the end toothed portion of the ring gear and a disengagement state disengaging from the end toothed portion of the ring gear, wherein when a resistance smaller than a torque outputted by the motor is encountered while the driving member is driving a fastener, the transmission shaft is in the meshing state and drives the ring gear to rotate, and the driving member is rotated to continuously drive the fastener, and wherein when a large resistance larger than the torque outputted by the motor is encountered at a position while the driving member is driving the fastener, the transmission shaft is in the disengagement state and causes a tooth slippage phenomenon in which the transmission shaft repeatedly engages with and disengages from the end toothed portion of the ring gear, such that the ring gear cannot be rotated, the body is permitted to be manually rotated to overcome the large resistance and to forcibly drive the fastener through the position via the driving member, and the transmission shaft reengages with the ring gear after the fastener passes through the position.

11. The electric ratchet wrench as claimed in claim 10, further comprising a direction switching device including a direction switching rod extending through the driving member along a second axis perpendicular to the first axis, with the direction switching rod pivotable relative to the driving member between two positions respectively corresponding to a driving direction and a non-driving direction, with the pawl device including two primary pawls and a secondary pawl, with the two primary pawls configured to selectively mesh with the toothed portion of the body, and with the inner toothed portion of the ring gear configured to selectively mesh with the secondary pawl, wherein when the direction switching rod pivots between the two positions, an engagement status between each of the two primary pawls and the toothed portion of the body and an engagement status between the secondary pawl and the ring gear are changed to provide a direction switching function.

12. The electric ratchet wrench as claimed in claim 11, with each of the two primary pawls including first and second primary toothed sections respectively located on opposite ends of a side of the primary pawl facing away from the driving member, with the first and second primary toothed sections configured to selectively mesh with the toothed portion of the body, with the secondary pawl including first and second secondary toothed sections respectively located on opposite ends of a side of the secondary pawl facing away from the driving member, and with the first and second secondary toothed sections configured to selectively engage with the inner toothed portion of the ring gear for joint rotation.

13. The electric ratchet wrench as claimed in claim 11, with the driving device further including first and second pins, with the driving member rotatably mounted in the body and rotatable about the second axis, with the first pin extending through the driving member, one of the two primary pawls, and the secondary pawl, permitting the one of the two primary pawls and the secondary pawl to jointly pivot relative to the driving member about a third axis parallel to the second axis and defined by the first pin, with the second pin extending through the driving member and another of the two primary pawls, permitting the other of the two primary pawls to pivot relative to the driving member about a fourth axis parallel to the second axis and defined by the second pin, with the second axis located between the third and fourth axes, with the two primary pawls located on a same level along the second axis, and with the secondary pawl located a level different from the two primary pawls along the second axis and spaced from the second axis in a radial direction perpendicular to the second axis.

14. The electric ratchet wrench as claimed in claim 11, with the direction switching rod including a through-hole extending in a diametric direction perpendicular to the second axis, with the direction switching rod further including a receptacle spaced from the through-hole of the direction switching rod along the second axis, with the receptacle having an opening, with the direction switching device further including a primary pressing unit and a secondary pressing unit, with the primary pressing unit mounted in the through-hole of the direction switching rod and including two first pressing members and a first biasing element mounted between the two first pressing members and biasing the two first pressing members to respectively press against the two primary pawls, and with the secondary pressing unit mounted in the receptacle of the direction switching rod and including a second pressing member and a second biasing element biasing the second pressing member to press against the secondary pawl.

15. The electric ratchet wrench as claimed in claim 10, with the body including a head and an extension between the head and the handle, with the head located on the first end of the body, with the handle located between the extension and the second end of the body along the first axis, with the head including a driving hole and a transmission groove intercommunicated with the driving hole, with the driving hole including the inner periphery having the toothed portion, with the handle including a compartment receiving the power device, with a connection hole defined in the extension, with the handle of the body including the through-hole, and with the through-hole intercommunicated with the compartment.

* * * * *